US010111507B2

(12) United States Patent
Daly

(10) Patent No.: US 10,111,507 B2
(45) Date of Patent: Oct. 30, 2018

(54) WHEELED SUITCASE WITH BEVERAGE HOLDER

(71) Applicant: Stephen Daly, Limerick City (IE)

(72) Inventor: Stephen Daly, Limerick City (IE)

( * ) Notice: Subject to any disclaimer, the term of this patent is extended or adjusted under 35 U.S.C. 154(b) by 60 days.

(21) Appl. No.: 14/888,326

(22) PCT Filed: Apr. 30, 2014

(86) PCT No.: PCT/GB2014/051336

§ 371 (c)(1),
(2) Date: Oct. 30, 2015

(87) PCT Pub. No.: WO2014/177863

PCT Pub. Date: Nov. 6, 2014

(65) Prior Publication Data

US 2016/0073752 A1 Mar. 17, 2016

(30) Foreign Application Priority Data

May 1, 2013 (GB) ..... 1307829.0
Nov. 25, 2013 (GB) ..... 1320769.1

(51) Int. Cl.

| | |
|---|---|
| ***A45C 13/02*** | (2006.01) |
| ***A45C 5/14*** | (2006.01) |
| ***A45C 5/03*** | (2006.01) |
| ***A45C 5/06*** | (2006.01) |

(52) U.S. Cl.

CPC ..... *A45C 13/02* (2013.01); *A45C 5/03* (2013.01); *A45C 5/06* (2013.01); *A45C 5/14* (2013.01); *A45C 2013/026* (2013.01); *A45C 2200/20* (2013.01)

(58) Field of Classification Search

CPC ..... A45C 2200/20; A45C 13/02; A45C 13/20; A45C 2013/267

USPC ..... 224/148.4, 148.7; 220/592.16

See application file for complete search history.

(56) References Cited

U.S. PATENT DOCUMENTS

| | | | | |
|---|---|---|---|---|
| 2,209,781 A * | 7/1940 | Lewis | A45C 13/02 | 190/109 |
| 4,916,923 A * | 4/1990 | Adams | A45C 11/20 | 62/457.1 |
| 5,240,106 A * | 8/1993 | Plath | A45C 5/14 | 190/102 |
| 6,481,239 B2 * | 11/2002 | Hodosh | A45C 11/20 | 220/592.17 |

(Continued)

*Primary Examiner* — Sue A Weaver

(74) *Attorney, Agent, or Firm* — Donn K. Harms

(57) ABSTRACT

A wheeled suitcase comprises an extendable handle, a main chamber, and a beverage container holder adapted to releasably hold a disposable hot drinks cup or can in a substantially fixed position relative to the suitcase, or adapted to releasably hold a plurality of hot drinks cups or cans side by side in a substantially fixed position relative to the suitcase. When the holder is in use a beverage container held thereby at least partly extends above the beverage container holder so as to aid its removal from the holder. When the suitcase is rested on its wheels in a substantially upright position such that the handle is substantially vertical a beverage container in the holder is held at an angle of 30 degrees or less to the vertical. The suitcase further comprises a beverage container cover adapted to shield a beverage container retained in the holder.

23 Claims, 6 Drawing Sheets

(56) References Cited

U.S. PATENT DOCUMENTS

| | | | | |
|---|---|---|---|---|
| 6,609,599 | B1 * | 8/2003 | Chang | A45C 13/02 16/113.1 |
| 7,841,207 | B2 * | 11/2010 | Mogil | A45C 11/20 62/457.1 |
| 8,485,327 | B1 * | 7/2013 | Dalrymple | A45C 9/00 190/11 |
| 2003/0042091 | A1 * | 3/2003 | Oh | A45C 5/06 190/111 |
| 2005/0139741 | A1 * | 6/2005 | Yuen | A45C 11/20 248/311.2 |
| 2005/0263527 | A1 * | 12/2005 | Maldonado | A45C 11/20 220/592.2 |
| 2006/0243768 | A1 * | 11/2006 | Dowell | B60R 11/00 224/400 |
| 2009/0051133 | A1 * | 2/2009 | Oshiro | A63B 67/06 280/47.18 |
| 2009/0127046 | A1 * | 5/2009 | King | A45C 9/00 190/18 A |

* cited by examiner

WHEELED SUITCASE WITH BEVERAGE HOLDER

The present invention relates to improvements in wheeled suitcases. More specifically the present invention relates to a wheeled suitcase comprising a pocket housing a support for a beverage container. In particular the suitcase comprises a holder adapted for use beverage containers that are open, for example cups of hot beverages that may or may not have a lid thereon or opened cans of beverage.

The problem of transporting cups of hot beverages when in transit, particularly by air or rail travel, has prompted various attempts at solutions.

For example, U.S. Pat. No.2006219745A1 discloses a beverage support that may be hung from the handle of a wheeled suitcase. U.S. Pat. No. 6,609,599B1 discloses a beverage support formed integrally in the upper surface of a wheeled suitcase.

However, all of the prior art solutions have various drawbacks, notably that when in use any drink held therein may be prone to spillage and if a hot beverage is indeed spilled it may harm nearby members of the public.

The present invention seeks to address these problems.

According to a first aspect of the present invention there is provided a wheeled suitcase comprising:

an extendable handle and a main chamber;

a beverage container holder adapted to releasably hold a disposable hot drinks cup or drinks can in a substantially fixed position relative to the suitcase; wherein when the holder is in use a beverage container held thereby remains at least partly exposed from the holder so as to aid its removal from the holder by a user;

when the suitcase is rested on its wheels in a substantially upright position such that the handle is substantially vertical a beverage container in the holder is held at an angle of 30 degrees or less to the vertical;

the suitcase further comprising a beverage container cover adapted to shield a beverage container retained in the holder to protect passers by from spillage of the beverage.

The provision of a beverage container cover allows for a cup of hot beverage or open drinks can to be transported without endangering other members of the public or their items of property with the risk of spillage. This is of particular importance for protecting electrical equipment and in the instance of beverages that might stain or scald. In order that a cup of hot beverage may be safely transported when it is held by the suitcase the beverage container holder must securely hold the beverage container in a substantially fixed position in order to prevent the container moving around and spilling.

The holder must also hold the container in an upright position when the suitcase is in use. This allows a user to rest the suitcase to deal with other matters such as flight check-in or airport security. This also allows a user to transport a beverage in the suitcase by rolling the suitcase on its wheels in the normal manner without spillage of the drink. Depending upon how full the beverage container is and the position of any lid it may be acceptable in certain circumstances for the beverage container to be retained at an angle of up to 30 degrees to the vertical without serious spillage occurring.

In some embodiments the holder is adapted to a single disposable hot drinks cup or drinks can in a substantially fixed position relative to the suitcase, or adapted to releasably hold a plurality of hot drinks cups or drinks cans side by side in a substantially fixed position relative to the suitcase.

In some embodiments when the holder is in use an upper part of the beverage container held thereby remains at least partly exposed from the holder so as to aid its removal from the holder by a user.

In some embodiments when the holder is in use an upper part of the beverage container held thereby remains at least partly exposed from the holder on substantially diametrically opposed sides of the beverage container so as to aid its removal from the holder by a user.

In some embodiment when the holder is in use a beverage container held thereby at least partly extends above the beverage container holder so as to aid its removal from the holder by a user.

In some embodiments a beverage container holder is adapted to at least part encircle a beverage container.

In some embodiments a beverage container holder is adapted to fully encircle a beverage container.

In some embodiments when the suitcase is rested on its wheels in a substantially upright position a beverage container in the holder is held at an angle of 20 degrees or less to the vertical.

In some embodiments when the suitcase is rested on its wheels in a substantially upright position a beverage container in the holder is held at an angle of 15 degrees or less to the vertical.

In some embodiments when the suitcase is rested on its wheels in a substantially upright position a beverage container in the holder is held at an angle of 10 degrees or less to the vertical.

In some embodiments when the suitcase is rested on its wheels in a substantially upright position a beverage container in the holder is held at an angle of 5 degrees or less to the vertical.

In some embodiments the holder is adjustable such that a user may select an angle to the vertical at which the beverage holder retains a container.

By allowing a user to select an angle at which the beverage holder retains a container a user is able to choose the correct angle for their own use, depending upon at which angle they transport their suitcase.

Preferably a beverage container in the holder is angled to the vertical away from the handle.

Wheeled suitcases are angled in order to transport them. Thus, the beverage holder may hold beverage container at an angle to the vertical away from the handle when the suitcase is at rest. This means that when the suitcase is angled and in motion the beverage container is 'righted' and held in a more substantially upright position.

In some embodiments when the suitcase is rested on its wheels in a substantially upright position a beverage container in the holder is substantially vertical.

In some embodiments a beverage container holder is pivotably attached to the suitcase such that the holder may self-adjust its angle under the weight of a cup.

By providing a beverage container holder that is pivotably attached to the suitcase the holder may self-adjust its angle under the weight of a cup of beverage such that the cup remains substantially vertical during transportation even with the angle of the suitcase varying.

In some embodiments the suitcase comprises a plurality of beverage container holders.

In some embodiments a beverage container holder is located outside of the main chamber.

In some embodiments a beverage container holder is accessible to a user without opening the main chamber of the suitcase.

In some embodiments a beverage container holder is located in the upper half of the suitcase.

In some embodiments a beverage container holder is at or adjacent the top of the suitcase.

In some embodiments the holder for a beverage container is located within a pocket the suitcase.

Providing a beverage container holder in a pocket allows for the holder to be readily stored when not in use.

In some embodiments the holder is secured to a panel part-defining a pocket of the suitcase with the holder located within the pocket.

In some embodiments the pocket is lined with a substantially waterproof material.

Lining the pocket with a water-proof material means that if spillage does occur the contents of the suitcase should not be harmed.

In some embodiments the pocket may be substantially closed so as to seal the pocket from the exterior of the suitcase.

Fully sealing the pocket provides that any spillage cannot harm a member of the public.

In some embodiments the beverage container may be supported on a pocket flap.

In some embodiments the cover extends from the inside of a pocket.

In some embodiments the cover extends from a pocket flap.

In some embodiments the cover is a pocket flap.

Use of a pocket flap as a cover reduces the material required to make the suitcase in comparison to a suitcase having a dedicated beverage cover.

In some embodiments the beverage cover is adapted so as to contact the beverage container and restrict the movement thereof when the support is in use.

In some embodiments the beverage cover is formed at least in part from an elastic material.

Use of an elastic material allows for a cover to readily restrict the movement of different sizes of beverage containers. In such embodiments the beverage container holder may be the same as the beverage container cover.

In some embodiments the beverage cover is attached at least in part to the suitcase by an elastic material.

In some embodiments the cover is formed of a substantially waterproof material.

In some embodiments the cover is formed of a textile material.

In some embodiments the beverage container may be substantially covered by the beverage container cover.

In some embodiments the beverage container may be fully covered by the beverage container cover.

In some embodiments the beverage container holder comprises at least one elastic member.

In some embodiments the beverage container holder comprises a plurality of elastic members.

In some embodiments the beverage container holder comprises a support for a beverage container having a beverage container engaging means adapted to engage a portion of the container for holding the container on the support.

In some embodiments the beverage container engaging means comprises at least one upstanding engagement member extending upwardly from support.

In some embodiments the container engaging means comprises a plurality of spaced apart upstanding engagement members extending upwardly from the support, whereby the upstanding members define an outer periphery of the container.

In some embodiments the container engaging means comprises an opening extending through the support.

In some embodiments the support comprises a platform portion adapted for supporting a food item.

In some embodiments the support is hingeable relative to the panel within the pocket of the luggage container between the first and second states.

By allowing the support to hinge between useable and non-useable states the support is readily deployed and can be neatly stored.

In some embodiments the support forms the base of a pocket of the suitcase.

In some embodiments the support extends from a pocket of the suitcase and the beverage container may be retained thereon.

In some embodiments a beverage container holder is adapted to hold a single disposable hot drink cup or drinks can.

In some embodiments a beverage container holder is adapted to hold only a single disposable hot drink cup or drinks can.

In some embodiments a beverage container holder is may hold two disposable hot drink cups or drinks cans side by side.

According to a second aspect of the present invention there is provided a method of transporting a beverage container in a wheeled suitcase comprising the steps of:

providing provided a wheeled suitcase made in accordance with any of the above statements of invention retaining a beverage container in the beverage container engaging means such that the beverage container is substantially covered by the beverage container cover; and wheeling the suitcase.

The invention will be more clearly understood from the following description of some embodiments thereof, which are given by way of example only, with reference to the accompanying drawings, in which.

Figure 1:
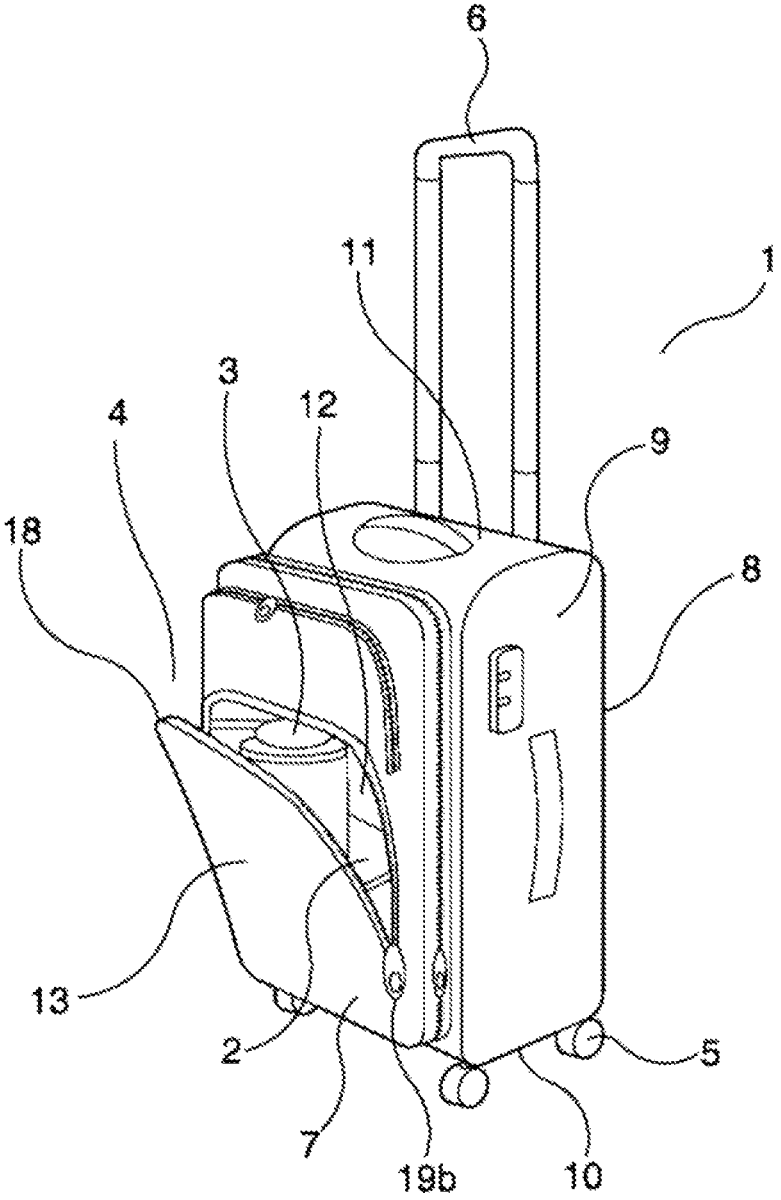
FIG. 1 is a perspective view of a wheeled suitcase according to a first embodiment of the present invention showing a beverage container support within a front pocket.
Figure 2:
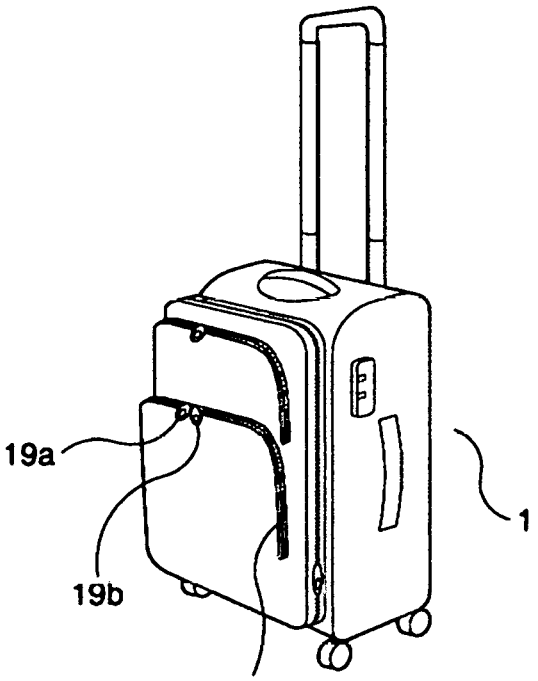
FIG. 2 is a perspective view of the wheeled suitcase of FIG. 1 wherein a beverage container is internally housed within the front pocket.

Referring to the drawings and initially to FIGS. 1 and 2, there is illustrated a wheeled suitcase according to a first embodiment of the present invention, which in this embodiment of the invention comprises a wheeled suitcase 1.

Wheeled suitcase 1 comprises a front wall 7, a rear wall 8, opposite side walls 9, a bottom wall 10 and a top wall 11, which together define a hollow interior region (not shown) for luggage.

Wheeled suitcase 1 further comprises four ground engaging wheels 5, which extend downwardly from the bottom wall 10 of suitcase 1 for facilitating wheeling thereof, although in other embodiments the suitcase might comprise other wheeling means, for example only two wheels. Suitcase 1 further comprises a telescoping handle 6 for facilitating wheeling suitcase 1.

A front pocket 4 is formed on front wall 7, the pocket being defined by a pocket flap 13 and a rear panel 12. Pocket 4 may be opened and closed by means of zip 18, which has two zip fasteners 19*a,* 19*b.*

Wheeled suitcase 1 has a support 2 for a beverage container 3 located within a front pocket 4 of wheeled suitcase 1. Support 2 is adapted for retaining a beverage container 3, for example, a disposable cup of tea, coffee or the like.

Figure 6:
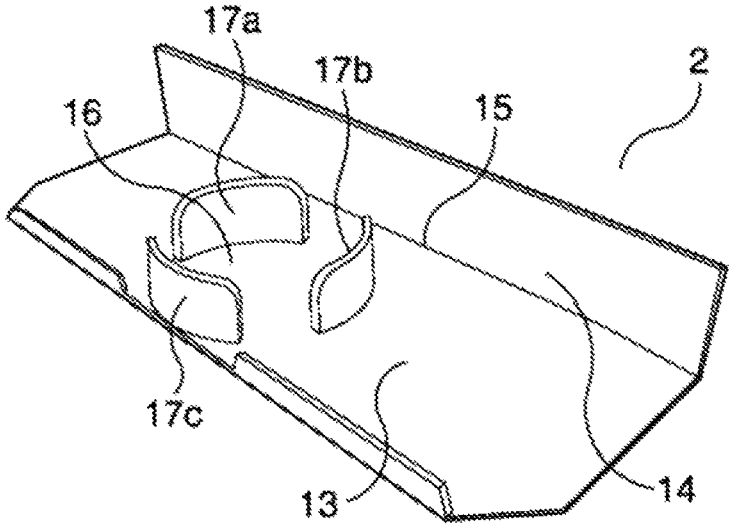
FIG. 6 shows in isolation a support of the type that might be used with an embodiment of the present invention.

Turning to FIG. 6, which shows in isolation the structure of support 2 it can be seen that support 2 comprises a tray 13 which is adapted for supporting the beverage container 3 thereon as well as other beverage containers and/or food items as will be described in more detail below.

A coupling means, in this embodiment of the invention a rear coupling panel 14 is hingedly coupled to tray 13 along a main hinge 15 so that tray 13 is hingeable relative to the rear coupling panel 14 between a first state with the tray 13 extending generally outwardly of the rear coupling panel 14 as illustrated in FIG. 6 with the support device 2 in a usable state, and a second state (not shown) with the tray 13 lying substantially adjacent the rear coupling panel 14 with the support device 2 in a folded state.

The rear coupling panel 14 is secured to panel 12 within the front pocket 4 with the support device 2 located within the front pocket 4. Any suitable securing means or fastening means may be provided for securing the rear coupling panel 14 of the support device 2 to panel 12, for example, the rear coupling panel 14 may be secured to the main panel 12 by an adhesive, by stitching or by other suitable securing means. Alternatively, the rear coupling panel 14 may be adapted to be releasably secured to the main panel 12 by suitable releasable fastening means, for example, one or more stud fasteners, a zip or the like.

A container engaging means 16 comprising three spaced apart upstanding engagement members 17*a,* 17*b,* 17*c* extend upwardly from tray 13 for engaging the outer periphery of a beverage container 3 adjacent a lower end thereof. Each engagement member 17*a,* 17*b*, 17*c* is of arcuate shape, and are configured on the tray 13 to define the lower periphery of the beverage container 3 in order to retain beverage container 3.

In the present embodiment support 2 has only a single beverage container holder in the form of container engaging means 16. Container engaging means is capable of holding only a single beverage container. However, it will be apparent that in other embodiments two or more beverage container holders could be provided by having additional beverage container engaging means on a tray.

In use, with the support device 2 located in the front pocket 4 and secured either permanently or releasably by the rear coupling panel 14 to the main panel 12 of the wheeled suitcase 1, the wheeled suitcase 1 is ready for use. When the support device 2 is not required to support a beverage container or other items, support device 2 is operated in the folded state with the tray 13 in the second state lying adjacent the rear coupling panel 14. This thereby permits the front pocket 4 to be used for storing other items.

When it is desired to use support device 2, the support device 2 is operated into the usable state by hinging the tray 13 from the second state to the first state.

Although not discussed herein it will be apparent that it may be preferable to provide a means to temporarily hold the support in its first state, for example a catch or clip.

A beverage container 3 or other container is engaged within the engagement means 16 and other comestibles, for example sandwiches and the like may be placed on the tray 13.

Front pocket 4 may then be completely or partially closed by means of zip 18 such that pocket flap 13 operates to cover beverage container 3 and prevent any spillage therefrom harming passers-by while suitcase 1 is in transit.

FIG. 2 illustrates suitcase 1 housing a beverage container 3 with pocket 4 entirely closed for maximum protection against dangerous hot beverage spillage.

Figure 3:
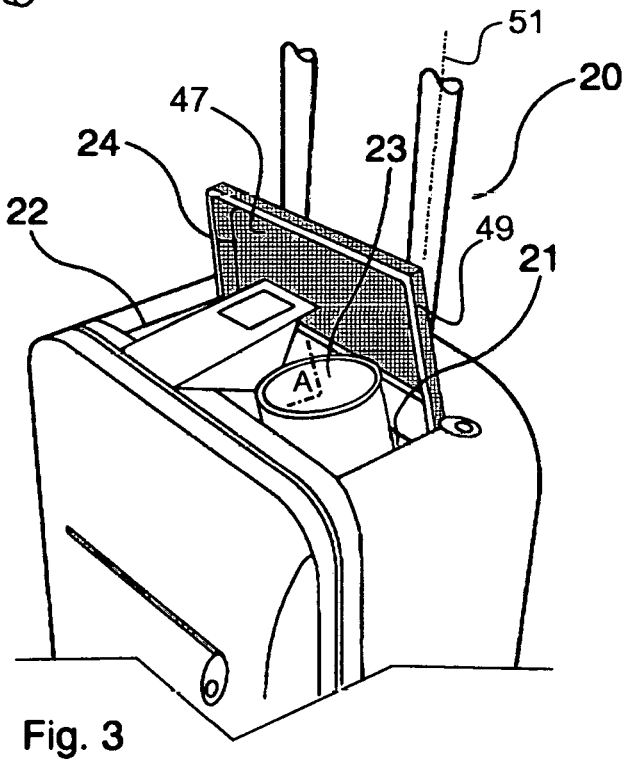
FIG. 3 is a perspective view of a wheeled suitcase according to a second embodiment of the present invention showing a beverage container support within an upper pocket.
Figure 4:
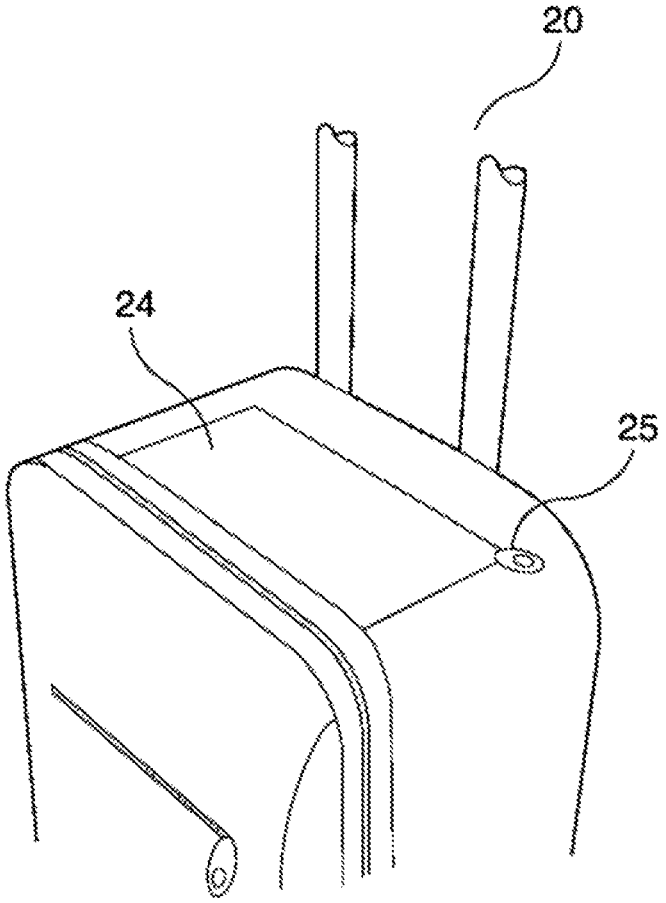
FIG. 4 is a perspective view of the wheeled suitcase of FIG. 3 wherein a beverage container is internally housed within the front pocket.

Referring now to FIGS. 3 and 4 there is illustrated a wheeled suitcase according to a second embodiment of the invention. The wheeled suitcase 20 is substantially similar to the wheeled suitcase 1.

Wheeled suitcase 20 also comprises a support device 21 which is similar to the support device 2 described with reference to the wheeled suitcase 1 of FIGS. 1 and 2, except support device 21 does not comprise a coupling panel 14, but is instead attached to base of pocket 22 at the underside of its tray.

The main difference between the wheeled suitcase 20 and the wheeled suitcase 1 is that the support device 21 instead of being located in the front pocket 4, is located in the top pocket 22 of the wheeled suitcase 20.

In this embodiment of the invention when the support device 20 is in use and retaining a beverage container 23, the top pocket 22 may have its pocket flap 24 cover beverage container 23 by closing pocket 22 with zip fastening 25.

Otherwise, the wheeled suitcase 20 and the support device 21 and their respective operations are similar to the wheeled suitcase 1 and the support device 2 described with reference to FIGS. 1 and 2.

In both embodiments of wheeled suitcases 1, 20 described thus far it will be apparent that it may be preferable to form pocket flaps 13, 24 out of, at least in part, an elastic material 47 (FIG. 3) in order that they might stretch such that their respective pockets may house a beverage container. Alternatively the pocket flaps could be attached around at least part of their periphery 49 by an elastic material 47. Further, as noted above and shown for example in FIG. 3, when the suitcase 1,20, is rested on its wheels in a substantially upright position such that the handle is substantially vertical a beverage container 23 in the holder is held at an angle A, which as previously noted is preferably an angle A, between 5 and 30 degrees off vertical for example as shown in FIG. 3 where the angle A angles away from the vertical line 51 of the handle.

Use of an elastic material further allows a pocket flap to press against any beverage container held within the pocket so as to hold the beverage container in place and thereby reduce the likelihood of spillage.

Figure 5:
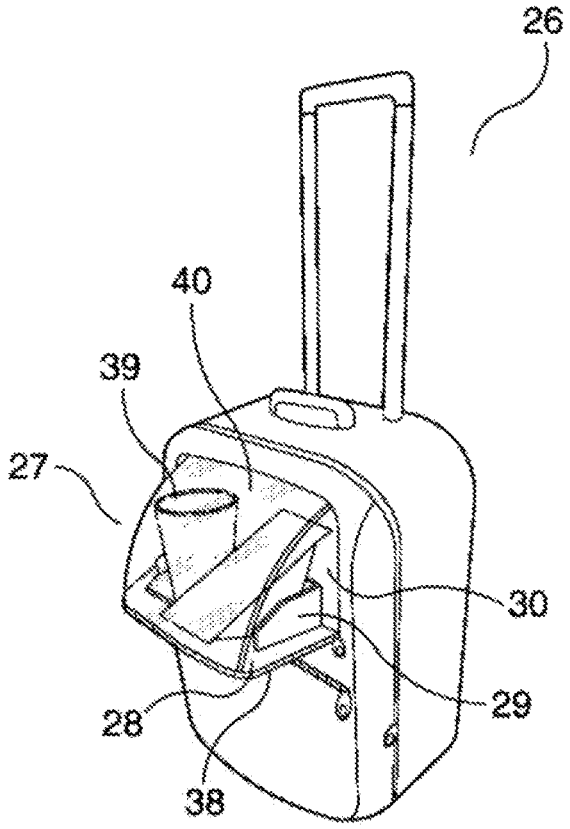
FIG. 5 is a perspective view of a wheeled suitcase according to a third embodiment of the present invention showing a beverage container supported on a pocket flap and protected by a cover.
Figure 7:
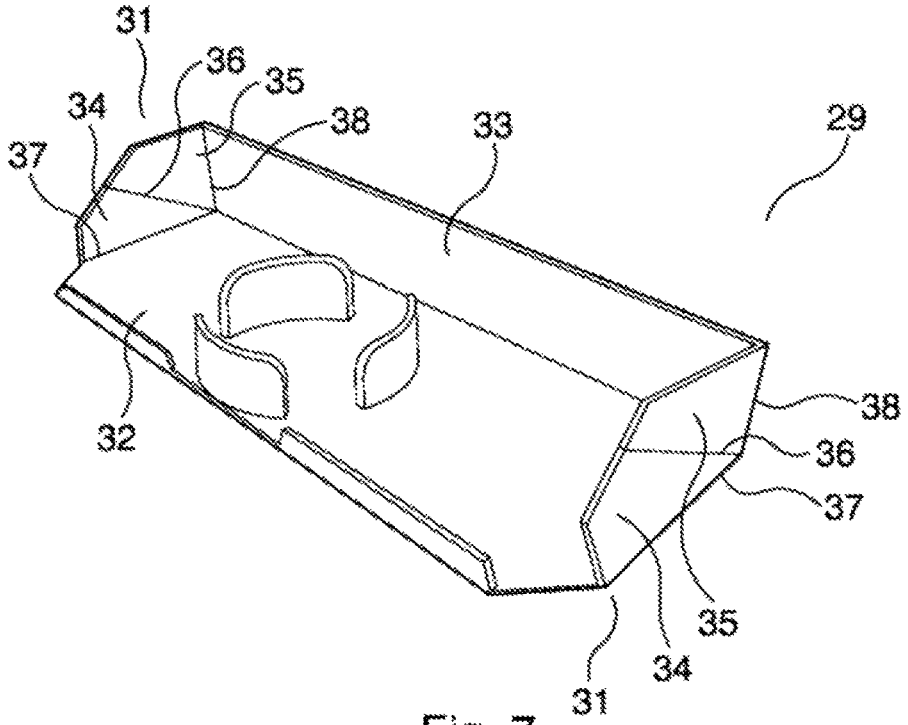
FIG. 7 shows in isolation a second support of the type that might be used with an embodiment of the present invention.

Turning to a third embodiment of the present invention and FIG. 5, a suitcase 26 comprises a front pocket 27 having a pocket flap 28 that is attached to the underside of a tray 32 of a support device 29, illustrated in isolation in FIG. 7.

Support device 29 is the same in form as support device 2 except that it comprises a retaining means, which in this embodiment of the invention comprises a pair of end walls 31 extending between the tray 32 and the rear coupling panel 33 at respective opposite ends thereof for retaining the tray 32 in the first state relative to the rear coupling panel 33. Each end wall 31 comprises a pair of end panels 34, 35 which are hingedly coupled together along respective intermediate plastics hinges 36. The end panels 34, 35 are hingedly coupled to adjacent corresponding ones of the tray 32 and the rear coupling panel 33 along bottom and rear plastics hinges 37 and 38, respectively. The end panels 34, 35 of the respective end walls 31 are hingeable around the intermediate plastics hinges 36 and the bottom and rear plastics hinges 37 and 38 between a first state illustrated in FIG. 7 corresponding to the first state of the tray 32 with the end panels 34, 35 of the end walls 31 lying in respective common planes and a second state (not shown) with the end panels 34, 35 of the respective end walls 31 in a second state lying adjacent each other and between the tray 32 and the rear coupling plate 33 with the tray in the second state.

Coupling panel 33 is attached to rear panel 30 of front pocket 27. Pocket flap 28 is alterable between a first configuration (not shown) wherein pocket flap is sealed around three sides of its periphery by zip fastener 38, pocket 27 is closed, and support 29 is held within pocket 27 in its second state, and a second configuration as shown in FIG. 5 wherein zip fastener 38 has been undone, pocket 27 is open and support 29 is in its first state and able to support a beverage container 39.

Suitcase 26 further comprises a beverage cover 40 that extends between rear panel 30 and pocket flap 28 and is configured so as to cover a beverage container 39 positioned on support 29.

While the support devices have been described as comprising an engagement means for engaging the beverage container provided by upstanding engagement members, any other suitable container engaging means for engaging the beverage container may be provided. For example, in certain cases, it is envisaged that the engagement means may be provided by an opening in the tray which would accommodate the beverage container therein, and the diameter or shape of the opening would correspond substantially with a shape or diameter of the container intermediate a bottom end and a top end of the beverage container for supporting the beverage container therein and in order to avoid the beverage container slipping through the opening. It is also envisaged that the container engaging means, be it provided by upstanding engagement members or by an opening, may be provided with an adjusting means, which would facilitate adjusting the engagement means for engaging or accommodating beverage containers of respective different shapes, sizes and/or diameters.

It will be apparent that one of the most important aspects of the present invention is that any hot beverage that is spilled from a beverage container retained by a support is not capable of coming into contact with members of the public.

Thus the beverage container cover merely needs to shield such accidentally spilled liquid from a nearby member of the public.

Thus, when the present application talks of the beverage container being 'shielded' by the beverage container cover this is to be interpreted to mean that a nearby member of the public would be shielded from any such spillage.

Thus the cover might or might not cover the upper opening of the beverage container so as to prevent spillage therefrom. It is preferable that the upper opening is covered but some embodiments might provide that a barrier extending up from the side of a beverage container is of a suitable height such that reasonable spillage could not surmount the barrier.

While the support devices of the above embodiments are formed of a plastics material, the support devices may be of any other suitable material.

Although in the present embodiments the supports comprise means to engage a single beverage container it will be apparent that any support might comprise means to engage a plurality of beverage containers.

Figure 8:
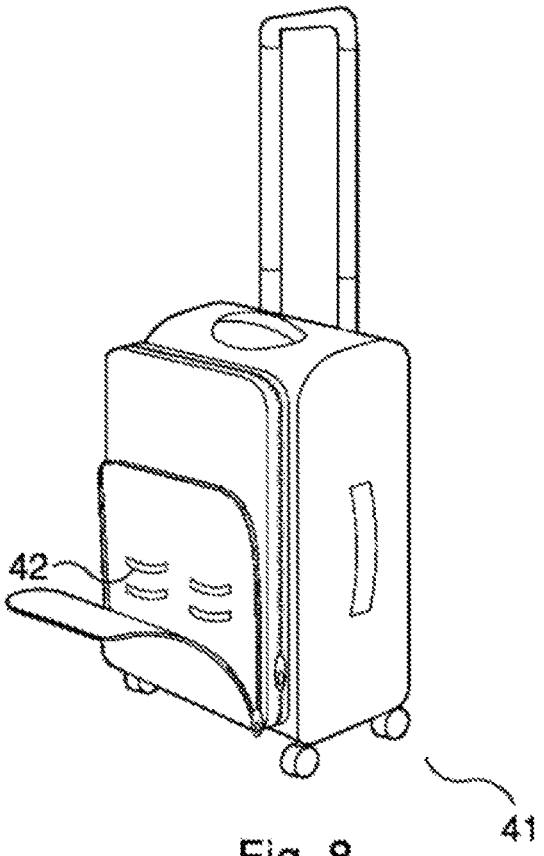
FIG. 8 is a perspective view of a further embodiment of the present invention.
Figure 9:
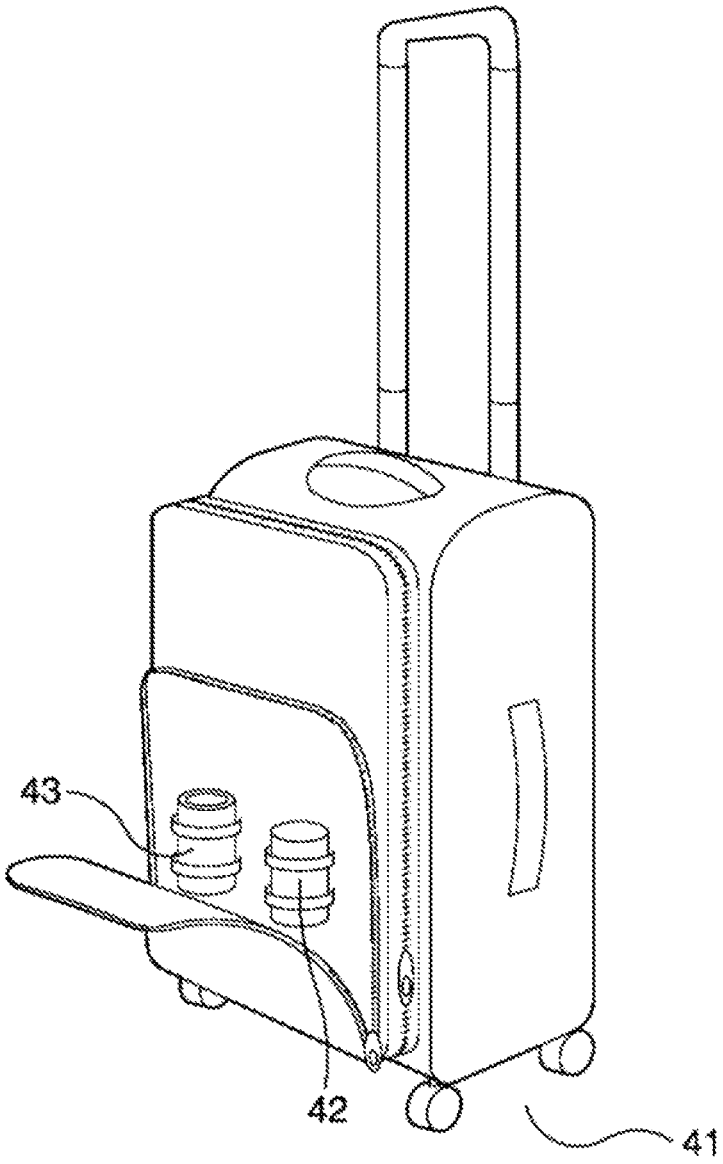
FIG. 9 is a perspective view of the suitcase of FIG. 8 in use.

Turning to FIGS. 8 and 9 and a further embodiment of the present invention a wheeled suitcase 41 comprises elastic straps 42 within a pocket that is coverable by a pocket flap.

In this embodiment two beverage container holders are provided, each comprising two elastic straps 42. It can be seen that each holder may hold a single beverage container 43 in a position that is substantially fixed relative to the suitcase and the beverage containers held thereby are side by side.

When suitcase 41 is rested on its wheels in a substantially upright position a beverage container 43 in the holder is substantially vertical.

In most embodiments the holder will hold a single beverage container, but other embodiments wherein the holder can retain a plurality of beverage containers side by side to each other such that each beverage container is individually removable from the holder without moving other beverage containers held thereby may be possible.

For example a beverage container holder in the form of at least one elastic strap could be provided wherein the strap is sufficiently extendable to encircle two beverage containers simultaneously.

As the device of the present invention is intended for use with open beverage containers such as hot cups of coffee or open cans it is not intended that any arrangement include the possibility of stacking beverage containers on top of each other. Instead in all embodiments the suitcase may have a holder or holders that carry a single container or a plurality of containers side by side.

In all embodiments at least part of a beverage container remains exposed from the holder in order to aid a user in removing the container from the holder. Typically an upper part of a beverage container will remain exposed, often by an upper part of a beverage container extending above the holder when retained thereby.

The invention is not limited to the embodiments hereinbefore described, which may be varied in construction and detail without departing from the scope of the present invention as set out in the appended claims.

What is claimed is:

1. A wheeled suitcase comprising:

an extendable handle and a main chamber;

a beverage container holder configured for a removable engagement with a single disposable hot drinks cup or drinks can in a substantially fixed position relative to the suitcase, wherein the holder in said removable engagement with a beverage container held thereby engages around a surface area of a periphery edge of said beverage container at only a lower portion of said beverage container;

an upper portion of said periphery edge of said beverage container opposite said lower portion in said removable engagement, at least partly extends above the beverage container holder;

when the suitcase is rested on its wheels in a substantially upright position such that the handle is substantially vertical a beverage container in said removable engagement with the holder is held at an angle of 30 degrees or less to the vertical;

the suitcase further comprising a beverage container cover removably positionable to a location adjacent to said upper portion of said beverage container, said container cover in said location forming a shield for the beverage container retained in the holder.

2. The suitcase of claim 1 wherein the removable engagement of the holder completely contacts all of said surface area of said beverage container around the entire said periphery thereof at said lower portion and said beverage container is a single disposable hot drinks cup or drinks can held in said substantially fixed position relative to the suitcase.

3. The suitcase of claim 1 herein when the holder is in use an upper part of the beverage container held thereby remains at least partly exposed from the holder whereby said upper part exposes a gripping portion around said periphery of said beverage container extending above said holder, said gripping portion graspable by a user so as to aid removal of said beverage container from the holder by a user.

4. The suitcase of claim 1 wherein when the holder is in use an upper part of the beverage container held thereby remains at least partly exposed from the holder on substantially diametrically opposed sides of the beverage container so as to aid its removal from the holder by a user.

5. The suitcase of claim 1 wherein when the holder is in use a beverage container held thereby at least partly extends above the beverage container holder so as to aid its removal from the holder by a user.

6. The suitcase of claim 1 wherein said beverage container holder is configured to fully encircle and completely contact the entire said surface area running around said periphery of said beverage container.

7. The suitcase of claim 1 wherein when the suitcase is rested on its wheels in said substantially upright position a beverage container in the holder is held at an angle of 20 degrees or less to the vertical, or is held at an angle of 15 degrees or less to the vertical, or is held at an angle of 10 degrees or less to the vertical, or is held at an angle of 5 degrees or less to the vertical.

8. The suitcase of claim 1 wherein a beverage container in the holder is angled to the vertical away from the handle.

9. The suitcase of claim 1 wherein when the suitcase is rested on its wheels in a substantially upright position a beverage container in the holder is substantially vertical.

10. The suitcase of claim 1 wherein a beverage container holder is located outside of the main chamber.

11. The suitcase of claim 1 wherein a beverage container holder is accessible to a user without opening the main chamber of the suitcase.

12. The suitcase of claim 1 wherein a beverage container holder is located in the upper half of the suitcase.

13. The suitcase of claim 1 wherein a beverage container holder is at or adjacent the top of the suitcase.

14. The suitcase of claim 1 wherein the holder for a beverage container is located within a pocket the suitcase.

15. The suitcase of claim 14 wherein the holder is secured to a panel part-defining a pocket of the suitcase with the holder located within the pocket.

16. The suitcase of claim 14 wherein the pocket is lined with a substantially waterproof material.

17. The suitcase of claim 14 wherein the pocket may be substantially closed so as to seal the pocket from the exterior of the suitcase.

18. The suitcase of claim 1 wherein the beverage cover is positionable in a contact with the beverage container and said contact restricts the movement thereof when the beverage cover is in use.

19. The suitcase of claim 1 wherein the beverage cover is formed at least in part from an elastic material.

20. The suitcase of claim 1 wherein the beverage cover is attached at least in part to the suitcase by an elastic material.

21. The suitcase of claim 1 wherein the cover is formed of a substantially waterproof material.

22. The suitcase of claim 1 wherein the beverage container may be substantially covered by the beverage container cover.

23. The suitcase of claim 1 wherein the beverage container may be fully covered by the beverage container cover.

* * * * *